United States Patent [19]

Habich et al.

[11] 4,278,356

[45] Jul. 14, 1981

[54] DAISY WHEEL PRINTER CARRIER

[75] Inventors: Adolph B. Habich; Ronald E. Hunt, both of Austin, Tex.

[73] Assignee: International Business Machins Corporation, Armonk, N.Y.

[21] Appl. No.: 53,646

[22] Filed: Jun. 29, 1979

[51] Int. Cl.[3] ..... B41J 11/20

[52] U.S. Cl. ..... 400/59; 400/57; 400/144.2

[58] Field of Search ..... 400/55, 56, 57, 59, 400/144.2, 144.3, 144.4

[56] References Cited

U.S. PATENT DOCUMENTS

| | | | |
|---|---|---|---|
| 3,960,256 | 6/1976 | Bickoff et al. | 400/55 X |
| 4,124,312 | 11/1978 | Johnson | 400/144.2 |
| 4,127,335 | 11/1978 | Bogert et al. | 400/144.2 |
| 4,134,695 | 1/1979 | Randolph | 400/59 X |

OTHER PUBLICATIONS

"IBM Mag Card Adjustment Parts Manual," No. 241-5584-7, Jan. 1979.

"IBM Mag Card Service/Parts Manual," No. 241-59-92-0, Feb. 1978.

*Primary Examiner*—Paul T. Sewell

*Attorney, Agent, or Firm*—James H. Barksdale, Jr.

[57] ABSTRACT

A printer carrier for carrying both a selection motor and a carrier for print element and ribbon cartridges. The printer carrier is made up of a frame, adjustable rails, and a leadscrew follower, and is structured to be mounted on escapement rails. The adjustable rails are for accepting the selection motor and the carrier for print element and ribbon cartridges. Upon adjustment of the rails, the motor and cartridge carrier are oriented relative to a printer platen. The follower is for connecting the apparatus to a leadscrew for controlling escapement along the escapement rails.

9 Claims, 4 Drawing Figures

DAISY WHEEL PRINTER CARRIER

DESCRIPTION

CROSS-REFERENCES TO RELATED APPLICATIONS

U.S. patent application Ser. No. 053,648, filed June 29, 1979, entitled "Method And Apparatus For Connecting And Disconnecting A Motor And A Print Element", and having A. B. Habich and R. E. Hunt as inventors.

U.S. patent application Ser. No. 053,649, filed June 6, 1979, entitled "Carrier For Print Element And Ribbon Cartridges", and having A. B. Habich and R. E. Hunt as inventors.

U.S. patent application Ser. No. 968,287, filed Nov. 28, 1979, entitled "Font Changing Apparatus For Daisy Wheel Printer", and having A. B. Habich and R. E. Hunt as inventors.

U.S. patent application Ser. No. 968,321, filed Dec. 11, 1978, entitled "Print Element Cartridge", and having A. B. Habich and R. E. Hunt as inventors. U.S. patent application Ser. No. 968,322, filed Dec. 11, 1978, entitled "Print Element", and having A. B. Habich and R. E. Hunt as inventors.

U.S. patent application Ser. No. 968,320, filed Dec. 11, 1978, entitled "Print Package", and having A. B. Habich and R. E. Hunt as inventors.

BACKGROUND OF THE INVENTION

1. Field of the Invention

This invention generally relates to carriers for single element printers. More specifically, this invention deals with a daisy wheel printer carrier which carries both a selection motor and a carrier for print element and ribbon cartridges.

2. Description of the Prior Art

Any number of single element printers are available in the marketplace today. The most common fall into the golf ball and daisy wheel categories. Typical of the golf ball printers are those utilized in the IBM Mag Card "Selectric"* Typewriter and IBM Mag Card II Typewriter systems. The printers in both of these systems have a carrier carrying a print element which is tiltable and rotatable for printing. A basic distinction between the carriers in the above mentioned systems is that escapement in the first is rack and pawl controlled, whereas in the latter escapement is pawl and leadscrew controlled.

*Registered Trademark—International Business Machines Corporation

Somewhat typical of the daisy wheel printers on the market today is that used in the IBM 6240 Mag Card Typewriter system. The printer of this system has a carrier carrying a selection motor and a ribbon cartridge. The selection motor has a hub to which is connected a daisy wheel print element. The print element is rotatable for character selection during printing.

In the printers mentioned above, adjustment to obtain a desired quality of printing is somewhat complicated and time consumming. This is the case during both assembly and repair. The primary adjusting point is the platen and expensive supporting structure is required. Supporting structure and expense become major considerations when paper handling is considered. With the printer carrier of this invention, an inexpensive printer frame can be utilized, platen adjustments are eliminated, and paper handling is readily facilitated.

Other prior art related to daisy wheel printers include U.S. patent application Ser. No. 767,250, filed Feb. 10, 1977, now U.S. Pat. No. 4,127,335, and U.S. Pat. No. 4,124,312. In both of these references, a carrier is disclosed for carrying a daisy wheel print element housed in a cartridge, a ribbon cartridge, and a selection motor. Not shown in these references though, is a motor carrier which (1) in turn carries a carrier for print element and ribbon cartridges, and (2) is readily adjustable to affect both the motor and print element cartridge to obtain quality printing and provide for paper handling.

SUMMARY OF THE INVENTION

A daisy wheel printer carrier is provided for carrying a selection motor and a carrier for print element and ribbon cartridges. The printer carrier includes adjustable means in terms of rotatably adjustable eccentric rails. The motor and cartridge carrier are independently mountable upon the rails, horizontally translatable therealong and spring biased thereagainst. Upon rotation of the rails, the motor and the cartridge carrier are vertically translated for side-to-side and up-and-down orientation thereof relative to a platen included in the printer. The printer carrier also includes structure for (1) accommodating an adjustment means for horizontally translating the cartridge carrier along the rails toward and away from the platen, (2) accepting escapement rails included in the printer and along which the printer carrier is escaped during printing, and (3) accommodating a follower for accepting a leadscrew which controls escapement of the printer carrier.

DESCRIPTION OF THE PREFERRED EMBODIMENT

Figure 1:
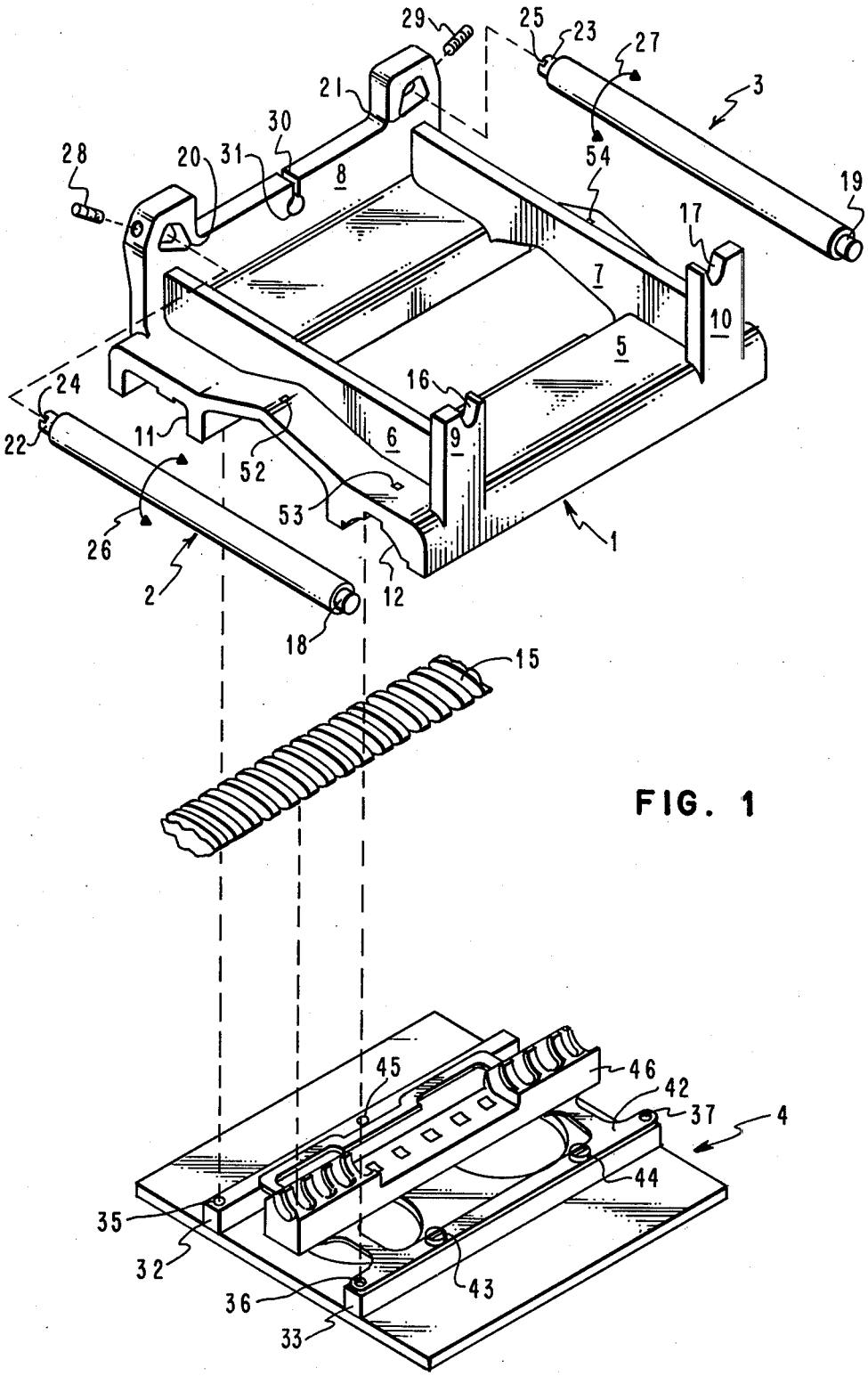
FIG. 1 is an exploded perspective view of the printer carrier of this invention and illustrates a cooperating leadscrew.
Figure 4:
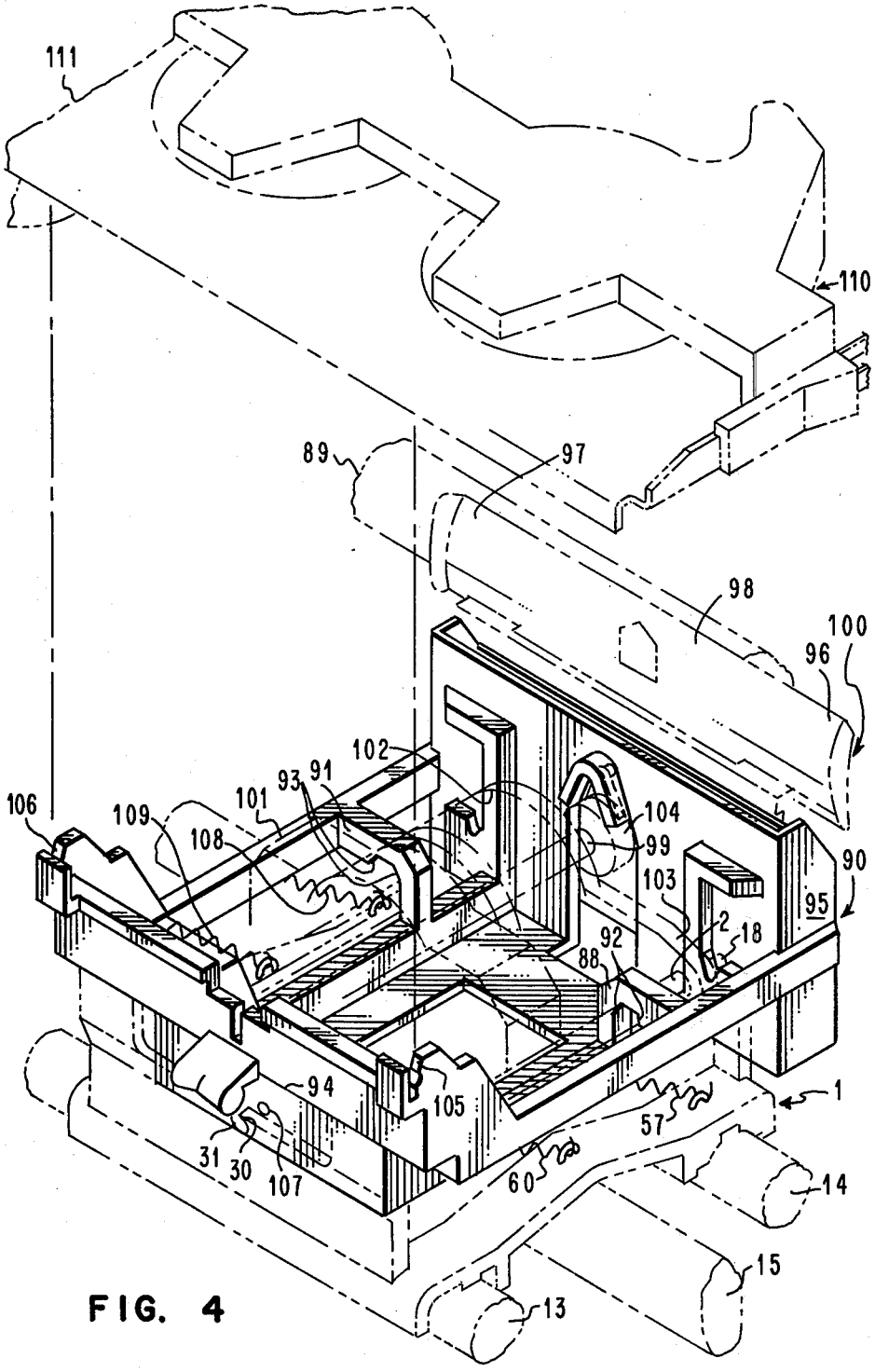
FIG. 4 is a perspective view primarily illustrating the structure and relationship of apparatus cooperating with the carrier of this invention.

For a more detailed understanding of the invention, reference is first made to FIG. 1. The primary components of the printer carrier according to this invention are a frame, a left adjustable eccentric rail, a right adjustable eccentric rail, and a base plate, generally designated by reference numerals 1, 2, 3, and 4, respectively. Frame 1 is preferably one piece, comprised of a molded rigid material. Included in frame 1 are a floor 5, ribs 6, 7, and 8, and uprights 9 and 10. Ribs 6, 7, and 8 and uprights 9 and 10 project perpendicularly upward from floor 5. On the underside of floor 5 and molded thereinto are channels 11 and 12. Channels 11 and 12 are for accepting escapement rails 13 and 14 (FIG. 2) along which frame 1 is escaped upon rotation of a leadscrew 15. Escapement rails 13 and 14 are mounted between the sides of a printer frame (not shown) and parallel to a printer platen 89 (FIG. 4). Frame 1 is escaped between the sides of the printer frame during printing on a record medium (not shown) against the platen.

Located in the upper portions of uprights 9 and 10 are V-shaped slots 16 and 17, respectively. Slots 16 and 17 are for accepting eccentric extensions 18 and 19 of rails 2 and 3, respectively. Within the upper ends of rib 8 are openings 20 and 21 for accepting eccentric extensions 22 and 23 of rails 2 and 3, respectively. Eccentric extensions 18 and 22 have the same axis of rotation which is offset from the axis of rotation of the remainder of rail 2. Similarly, eccentric extensions 19 and 23 have the same axis of rotation which is offset from the axis of rotation of the remainder of rail 3. Extensions 22 and 23 have screwdriver slots 24 and 25 for accepting a screwdriver tip for rotating rails 2 and 3 in the direction of arrows 26 and 27. Following adjustment of rails 2 and 3, set screws 28 and 29 are tightened against extensions 22 and 23 to maintain rails 2 and 3 in adjusted positions.

Openings 20 and 21 have inwardly and downwardly extending V-shaped portions. Extensions 22 and 23 are forced into the V-shaped portions upon tightening set screws 28 and 29.

As will be explained in greater detail later herein, mountable upon eccentric rails 2 and 3 is cartridge carrier 90 (FIG. 4). Cartridge carrier 90 is translatable along rails 2 and 3 toward and away from platen 89.

Located in the upper middle of rib 8 is a downwardly extending slot 30. Slot 30 terminates in a circular opening 31 extending through rib 8. Slot 30 and opening 31 are for accommodating an adjustment means for adjusting cartridge carrier 90 on rails 2 and 3. If the adjustment means is a headed screw as illustrated in the above cross-referenced application Ser. No. 053,648, the tip thereof is threaded into opening 107 in cartridge carrier 90 and the shank thereof is freely movable within opening 31. In this case, slot 30 will permit separation of frame 1 and cartridge carrier 90 without one having to remove the screw from opening 107.

Figure 2:
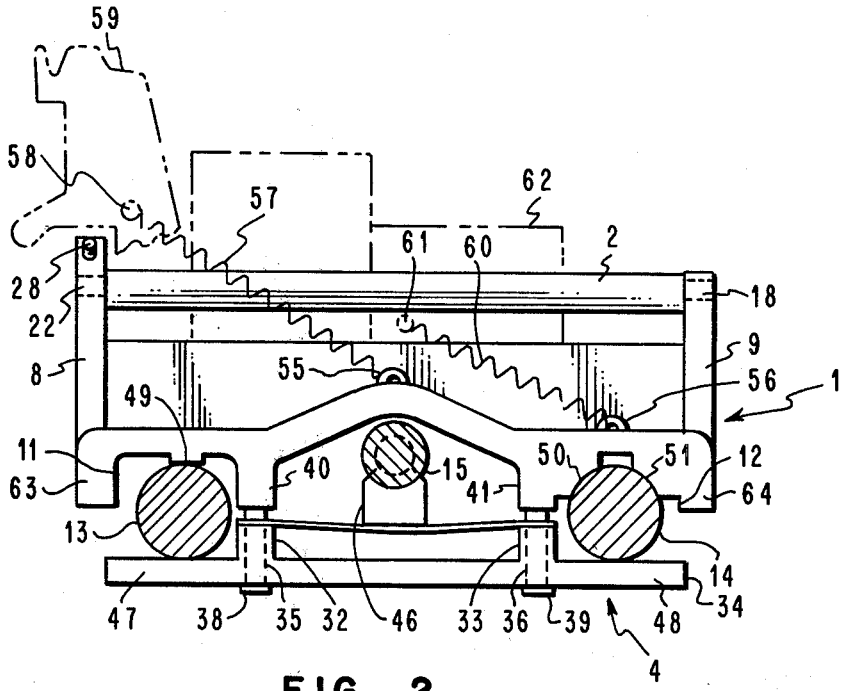
FIG. 2 is a side view of the carrier according to this invention illustrating escapement rail and leadscrew mounting.

Reference is next made to FIG. 2 in conjunction with FIG. 1. Base plate 4 is preferably one piece comprised of a molded rigid material. Base plate 4 is made up of a panel 34 having perpendicularly extending ribs 32 and 33. Extending through panel 34 and ribs 32 and 33 are openings 35, 36, 37, and 45 for accepting screws or rivets such as 38 and 39. The ends of rivets 38 and 39 are secured in lips 40 and 41 of channels 11 and 12. Positioned on top of ribs 32 and 33 and extending therebetween is a leaf spring 42. Leaf spring 42 is secured in place by screws 43 and 44. Leaf spring 42 is for supporting and urging a grooved leadscrew follower 46 into engagement with leadscrew 15. Due to the biasing affect of leaf spring 42, follower 46 is frictionally maintained in place against leaf spring 42. Follower 46 could also be secured to leaf spring 42 by screws or other suitable means. Ends 47 and 48 of panel 34 are for maintaining escapement rails 13 and 14 in channels 11 and 12, respectively. Within channel 11 is a bearing protuberance 49 which rides along escapement rail 13 upon escapement of frame 1. Within channel 12 are arcuate surfaced bearing protuberances 50 and 51. Protuberances 50 and 51 are to locate frame 1 on escapement rails 13 and 14 and ride along escapement rail 14 upon escapement of frame 1.

The top of panel 34 adjacent escapement rails 13 and 14 can also serve as a bearing surface against rails 13 and 14. In lieu of protuberances 49, 50, and 51, and the top of panel 34, other bearing means, such as ball bearings, could be used.

Located on each side of frame 1 are means for anchoring the ends of tension springs. In FIG. 1 these are represented by openings 52 and 53 on the left side of frame 1. Only opening 54 corresponding to opening 52 on the right side of frame 1 is shown in FIG. 1. In FIG. 2 the anchoring means corresponding to openings 52 and 53 in FIG. 1 are loops 55 and 56. One end of a spring 57 is secured to loop 55 and the other end to a stud 58. Stud 58 is secured adjacent to rear end 59 of print element and ribbon cartridge carrier 90. Cartridge carrier 90 is the subject of the above cross-referenced application Ser. No. 053,649. Another spring 60 has one end secured to loop 56 and the other end thereof secured to a stud 61. Stud 61 is secured to a selection motor 62. Spring 60 is for biasing selection motor 62 downwardly and to the right. In like manner, spring 57 is for biasing cartridge carrier 90 downwardly and to the right.

Figure 3:
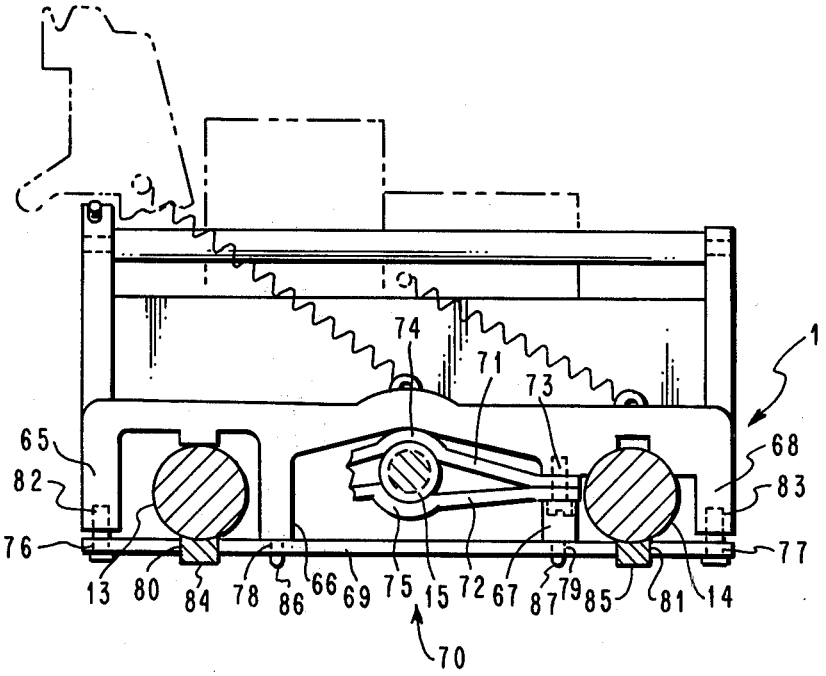
FIG. 3 is a side view similar to FIG. 2 illustrating another embodiment of leadscrew mounting.

Refer next to FIG. 3. In this figure there is illustrated a different arrangement for mounting frame 1 on escapement rails 13 and 14 and leadscrew 15. The primary frame differences are that channel lips 65, 66, 67, and 68 in FIG. 3 are longer than corresponding lips 63, 40, 41, and 64 in FIG. 2. Further, lip 67 has a recess within which a spring yoke made up of legs 71 and 72 are mounted by means of screw 73. Legs 71 and 72 have lands and grooves within bulged portions 74 and 75 for communicating with the lands and grooves of leadscrew 15.

A base plate generally designated by reference numeral 70 in FIG. 3 is somewhat different than base plate 4 in FIG. 2. Base plate 70 is made up of a panel 69 having screw openings such as 76 and 77, protuberance openings such as 78 and 79, and bearing receptacles such as 80 and 81. Screw openings 76 and 77 are for accepting screws such as 82 and 83 for securing panel 69 to frame 1. Within bearing receptacles 80 and 81 are fitted bearings 84 and 85 for communicating with escapement rails 13 and 14. Protuberance openings 78 and 79 are for accepting protuberances 86 and 87 which are integral with lips 66 and 67.

Although not shown, a better mode for connecting a yoke made up of legs 71 and 72 to leadscrew 15 may be to add lower supporting structure to frame 1 in order that the yoke may be mounted vertically.

Reference is next made to FIG. 4 wherein there is shown apparatus which cooperates with, and is related to, frame 1 and eccentric rails 2 and 3. Mountable upon frame 1 and specifically eccentric rails 2 and 3 is carrier 90 for print element and ribbon cartridges. Cartridge carrier 90 has hanging brackets 88 and 91. Hanging bracket 88 has a recess therein with angularly projecting shoulders 92 which are spaced sufficiently close so as to contact the circumference of eccentric rail 2 when cartridge carrier 90 is positioned thereon. Hanging bracket 91 has similar shoulders 93 spaced somewhat further apart. The spacing of shoulders 92 is for positively locating carrier 90 on rail 2. The spacing of shoulders 93 is to permit displacement of carrier 90 on frame 1 in the horizontal direction along rails 13 and 14 upon adjustment of eccentric rail 2. Positioned under lip 94 and adjacent each end thereof are additional hanging brackets (not shown) which are similar to 88 and 91.

When cartridge carrier 90 is positioned on eccentric rails 2 and 3 and rails 2 and 3 are adjusted, cartridge carrier 90 is oriented relative to a platen 89. Platen 89 is maintained by the printer frame (not shown) and is located parallel to escapement rails 13 and 14 and leadscrew 15. From FIGS. 2, 3, and 4, with rails 13 and 14, leadscrew 15, and platen 89 extending parallel to one another, rails 2 and 3 extend perpendicular to planes passing through the axis of rotation of platen 89 and the longitudinal axis of rails 13 and 14 and leadscrew 15. As far as orientation of cartridge carrier 90 in the vertical direction is concerned, rails 2 and 3 and any adjustment thereof are substantially independent of one another. This is so whether carrier 90 is to be side-to-side oriented relative to platen 89, or only vertically oriented relative to platen 89. Assuming perfect carrier components and identical rotational positions of rails 2 and 3, and ignoring horizontal displacement of carrier 90, adjustment of one of rails 2 and 3 will result in a side-to-side orientation of carrier 90. If both rails 2 and 3 are similarly adjusted, carrier 90 will only be vertically oriented relative to platen 89. At present, it is considered that only vertical orientation will be of concern.

Cartridge carrier 90 has a receptacle 95 within which a print element cartridge generally designated by reference numeral 100 is removably housed. A daisy wheel print element (not shown) is in turn removably housed in cartridge 100. The details of print element cartridge 100 are fully set out in co-pending U.S. patent application Ser. No. 968,321. The details of the print element are fully set out in co-pending U.S. patent application Ser. No. 968,322. With print element cartridge 100 positioned in receptable 95 of cartridge carrier 90, adjustment of eccentric rails 2 and 3 will also result in cardholder 98 of print element cartridge 100 being oriented side-to-side (96 to 97 or 97 to 96) or vertically relative to platen 89.

Also mountable upon eccentric rails 2 and 3 and oriented upon adjustment thereof is selection motor 62 having a shaft 99 and mounts 101 and 102. Although not shown for purposes of clarity, a print hammer is rigidly mounted on top of selection motor 62 for impacting the print element housed in cartridge 100 and causing printing against platen 89. Located on the end of mounts 101 and 102 are hanging brackets similar to 88 and 91. An example is hanging bracket 103 which is similar to hanging bracket 88. Secured to the end of shaft 99 is a drive hub 104 for rotating the print element housed in cartridge 100 during printing. The details of this hub are fully described in co-pending U.S. patent application Ser. No. 968,321. Therefore, motor 62 carries both the print element and the print hammer during printing. Since motor 62 is mounted on eccentric rails 2 and 3, adjustment thereof will also result in orientation of the motor, print hammer, and print element relative to platen 89.

Located in the back of cartridge carrier 90 are recesses 105 and 106. Recesses 105 and 106 are for accepting a mounting bracket 111 which carries a ribbon cartridge generally designated by reference numeral 110.

Referring again to openings 31 and 107, the adjustment means located therein is for adjusting the distance between cardholder 98 and platen 89 for paper handling purposes. If multiple carbons or multiple forms are to be printed, the distance between cardholder 98 and platen 89 must be greater than that for printing on a single sheet. A headed screw located in openings 31 and 107 represents an easily and readily adjustable means for accommodating paper handling.

Also illustrated in FIG. 4 are springs 108 and 109 which serve the same purposes as springs 57 and 60.

In summary, a daisy wheel printer carrier is provided for carrying a selection motor and a carrier for print element and ribbon cartridges. The printer carrier includes adjustable means in terms of rotatable eccentric rails. The motor and cartridge carrier are independently mountable upon the rails, horizontally translatable therealong and spring biased thereagainst. Upon rotation of the rails, the motor and the cartridge carrier are vertically translated for side-to-side and up-and-down orientation thereof relative to a platen included in the printer. The printer carrier also includes structure for (1) accommodating an adjustment means for horizontally translating the cartridge carrier along the rails toward and away from the platen, (2) accepting escapement rails included in the printer and along which the printer carrier is escaped during printing, and (3) accommodating a follower for accepting a leadscrew which controls escapement of the printer carrier.

While the invention has been particularly shown and described with reference to a preferred embodiment it will be understood by those skilled in the art that various other changes in form and detail may be made without departing from the spirit and scope of the invention.

What is claimed is:

1. A daisy wheel printer carrier for carrying both a selection motor and a carrier for print element and ribbon cartridges, said printer carrier comprising:

(a) a number of adjustable eccentric rails upon which said selection motor and cartridge carrier are mounted for translation toward and away from a platen; and (b) means mountable on a number of escapement rails for escapement along said platen, said means including means for accepting said eccentric rails, said eccentric rails (1) extending perpendicular to the direction said escapement rails extend, and (2) having an end portion having an axis of rotation offset from the axis of rotation of the remainder of said eccentric rails.

2. A printer carrier according to claim 1 wherein said eccentric rails include means for rotatably adjusting said eccentric rails and orienting said selection motor and cartridge carrier relative to said platen.

3. A printer carrier according to claim 1 including means for accepting adjustment means for adjusting said cartridge carrier toward and away from said platen.

4. A printer carrier according to claim 1 wherein said means mountable on said number of escapement rails includes means for mounting a leadscrew follower which is connectable to a rotatable leadscrew for controlling escapement of said printer carrier along said escapement rails.

5. A printer carrier according to claim 4 wherein said means mountable on said number of escapement rails includes channel means for accepting said escapement rails.

6. A printer carrier according to claim 1 wherein said means mountable on said number of escapement rails includes means for accepting said end portion.

7. A printer carrier according to claim 6 including means for securing said end portion to prevent rotation of said eccentric rails.

8. A printer carrier according to claim 5 including a base plate connectable to said means mountable on said number of escapement rails for maintaining said escapement rails in said channel means.

9. A printer carrier according to claim 1 including means for accepting biasing means for biasing said motor and said cartridge carrier toward said means mountable on said number of escapement rails.

* * * * *